US007318728B2

(12) United States Patent
Blackborn

(10) Patent No.: US 7,318,728 B2
(45) Date of Patent: Jan. 15, 2008

(54) HIGH-FREQUENCY COUPLER FOR CONNECTING A COAXIAL PLUG TO A HIGH-FREQUENCY TRANSMISSION LINE ON A CIRCUIT BOARD

(75) Inventor: Willem Blackborn, Inzell (DE)

(73) Assignee: Rosenberger Hochfrequenztechnik GmbH & Co., Fridolfing (DE)

( * ) Notice: Subject to any disclaimer, the term of this patent is extended or adjusted under 35 U.S.C. 154(b) by 48 days.

(21) Appl. No.: 10/564,530

(22) PCT Filed: Jul. 7, 2004

(86) PCT No.: PCT/EP2004/007438

§ 371 (c)(1),
(2), (4) Date: Jan. 13, 2006

(87) PCT Pub. No.: WO2005/006501

PCT Pub. Date: Jan. 20, 2005

(65) Prior Publication Data

US 2006/0166521 A1 Jul. 27, 2006

(30) Foreign Application Priority Data

Jul. 14, 2003 (DE) ..... 203 10 786 U

(51) Int. Cl.
*H01R 12/00* (2006.01)

(52) U.S. Cl. ..... 439/63; 439/83; 439/571

(58) Field of Classification Search ..... 439/83, 439/856, 857, 682, 63, 224, 581, 675, 668, 439/669, 571

See application file for complete search history.

(56) References Cited

U.S. PATENT DOCUMENTS

| | | | | |
|---|---|---|---|---|
| 5,281,166 | A | 1/1994 | Yu et al. | |
| 6,123,587 | A | 9/2000 | Beloritski et al. | |
| 6,238,218 | B1 * | 5/2001 | Baffert | 439/63 |
| 6,471,546 | B1 | 10/2002 | Zhu et al. | |
| 6,595,804 | B2 * | 7/2003 | Nagata | 439/668 |
| 6,752,658 | B2 * | 6/2004 | Jones | 439/581 |

* cited by examiner

*Primary Examiner*—Briggitte R. Hammond
*Assistant Examiner*—Vanessa Girardi
(74) *Attorney, Agent, or Firm*—Lowe Hauptman Ham & Berner LLP

(57) ABSTRACT

A high-frequency coupler connects a coaxial plug to a high-frequency transmission line on a printed circuit board. The coupler comprises a first pair of spring lamellae, for electrically contacting a middle conductor of the coaxial plug, and having a second pair of spring lamellae, for electrically contacting an outer conductor of the coaxial plug. A spring lamella of the first pair has, at an end facing away from coaxial plug, a contact surface that electrically connects the coupler to the transmission line on the printed circuit board and is mechanically connected to the printed circuit board. One spring lamella of the second pair has, at an end facing away from the coaxial plug, a contact surface that electrically connects the coupler to a printed circuit board ground contact and is mechanically connected to the printed circuit board.

18 Claims, 3 Drawing Sheets

HIGH-FREQUENCY COUPLER FOR CONNECTING A COAXIAL PLUG TO A HIGH-FREQUENCY TRANSMISSION LINE ON A CIRCUIT BOARD

RELATED APPLICATIONS

The present application is a national phase of PCT/EP2004/007438 filed Jul. 7, 2004 and is based on, and claims priority from, German Application Number 203 10 786.1, filed Jul. 14, 2003, the disclosures of which are hereby incorporated by reference herein in its entirety.

FIELD OF THE INVENTION

The present invention relates to an HF connector for connecting a coaxial plug connector to an HF transmission line on a circuit board.

BACKGROUND OF THE INVENTION

During the manufacturing of circuit boards arranged for screening in a metal housing and having an HF connection which is fed through the housing, firstly the circuit board, with the components fitted and soldered in a hot air furnace is mounted in the open housing and, in a subsequent manual step, an HF coaxial plug connector is pushed through a perforation of the housing. Corresponding soldering tags on the HF connector have then to be soldered to the circuit board separately before a cover closing the housing can be mounted. This manufacturing process is disadvantageous to the extent that the additional manual soldering process entails a high cost and does not offer such a high level of reliability as the soldering of the components in the hot air furnace. Additionally, circuit boards and HF coaxial plug connectors cannot easily be replaced in the event of damage.

It is an object of the invention to improve an HF connector of the aforementioned type such that an automated manufacturing process can be carried out reliably and at little cost.

SUMMARY OF THE INVENTION

One aspect of the invention relates to an HF connector having at least a first pair of sprung blades arranged and designed for electrically contacting a central conductor of the coaxial plug connector, and at least a second pair of sprung blades arranged and designed for electrically contacting an outer conductor of the coaxial plug connector, whereby at least one sprung blade of the first pair has, on an end facing away from the coaxial plug connector, a contact surface for electrically connecting the HF connector to the HF transmission line on the circuit board and for mechanical connection with the circuit board and at least one sprung blade of the second pair has, on an end facing away from the coaxial plug connector, a contact surface for electrically connecting the HF connector to a chassis contact on the circuit board and for mechanical connection with the circuit board.

This has the advantage that, at the same time as components are inserted and soldered into the circuit board, the HF connector can also be inserted and soldered, whereby for manufacturing an HF connection and electrical contact with the circuit board, for example, through a housing, only the coaxial plug connector needs to be inserted between the sprung blades, without the need for additional soldering to create the electrical contacts between the HF coaxial plug connector and the circuit board. By this means, the coaxial plug connector may also be removed or exchanged at any time without the housing surrounding the circuit board having to be opened for this purpose, and soldering operations carried out.

Circuit boards can be easily and automatically equipped with the HF connector that is in the form of a surface-mounted component, such that the contact surfaces of the sprung blades are arranged in a plane parallel to the circuit board.

Suitably, the coaxial plug connector has a housing feed-through section for a housing surrounding the circuit board.

In a preferred embodiment, all the sprung blades extend in a plane parallel to the circuit board.

For good and reliable signal transmission, the sprung blades of the first pair are designed in one piece in the region of the contact surface.

In order to form a predetermined capture range for a contact region of the coaxial plug connector, the sprung blades of a pair are angled away from each other at their end facing towards the coaxial plug connector.

In order to facilitate the automatic arrangement of the HF connector on a circuit board in a component inserting machine, the HF connector has a housing which carries all the sprung blades. By this means, a gripping tip of the component inserting machine need only grasp the housing and position it on the circuit board, whereby all the sprung blades are automatically correctly arranged and positioned. The housing is suitably designed as a planar component and preferably has at least one peg which extends away from the housing for engaging in the circuit board.

Suitably, the housing has a cut-out into which the free ends of the sprung blades which face towards the coaxial plug connector extend. By this means, the coaxial plug connector can be inserted between the sprung blades without substantial adaptation to the housing of the HF connector.

In a preferred further development of the invention, the peg is designed to engage a hole in the circuit board, whereby the peg has at least one detent lug which extends in the radial direction in relation to the peg, beyond its outer periphery, wherein the detent lug is designed and arranged on the peg such that the outer periphery of the peg is smaller in the region of the detent lug than the diameter of the hole in the circuit board, whereby the outer periphery of the section of the peg protruding into the hole in the circuit board is designed such that between the outer periphery of this section and the inner wall of the hole in the circuit board, over at least a portion of the outer periphery there is an intermediate space with capillarity for solder, such that solder situated on the surface of the circuit board during a soldering procedure penetrates by capillary action into the intermediate space, filling it.

This has the advantage that for inserting and locking the component into the circuit board, it is not necessary to apply a particularly great force, so that this work can be carried out automatically by machine in a production line for circuit boards with a component inserting machine and a hot air furnace, whereby after the soldering procedure in the hot air furnace, locking of the component is automatically achieved by the solder that has penetrated into the hole in the circuit board. At the same time, a tolerance-free form-fit takes place between the peg and the inner periphery of the hole in the circuit board in a plane of the circuit board. The insertion of components with locking can therefore be carried out very economically, simultaneously producing good holding forces and with little tolerance.

A form-fitting connection without tolerance in the direction along a longitudinal axis of the hole in the circuit board is thereby achieved that the detent lug is designed and arranged on the peg such that with the component fully inserted into the circuit board, the detent lug is arranged within the hole in the circuit board.

In order further to promote the capillary action, the periphery of the peg is designed with at least one cut-out in the longitudinal direction over the entire section situated in the hole in the circuit board.

A particularly good form-fit between the solder penetrating into the hole in the circuit board and the circuit board is thereby achieved that the hole in the circuit board is metallised.

BRIEF DESCRIPTION OF THE DRAWINGS

The invention will now be described in greater detail by reference to the drawings, in which.

DETAILED DESCRIPTION OF THE DRAWINGS

Figure 1:
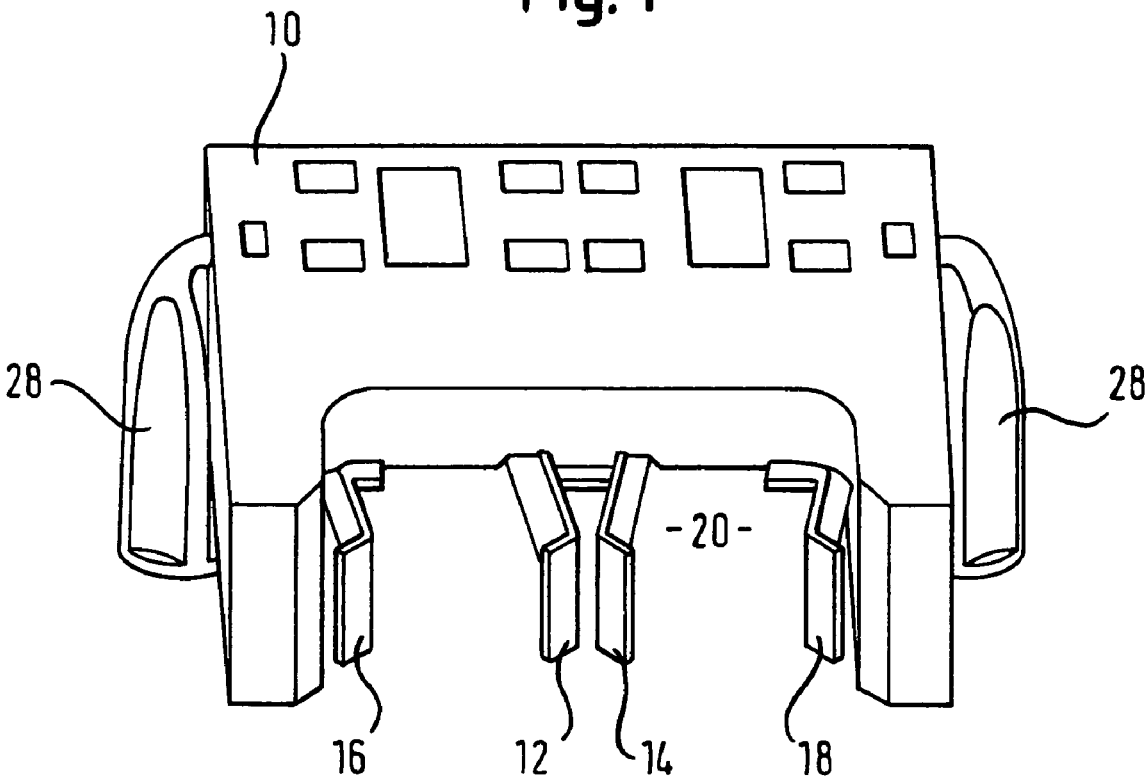
FIG. 1 shows a perspective view from above of a preferred embodiment of an HF connector according to the invention.
Figure 2:
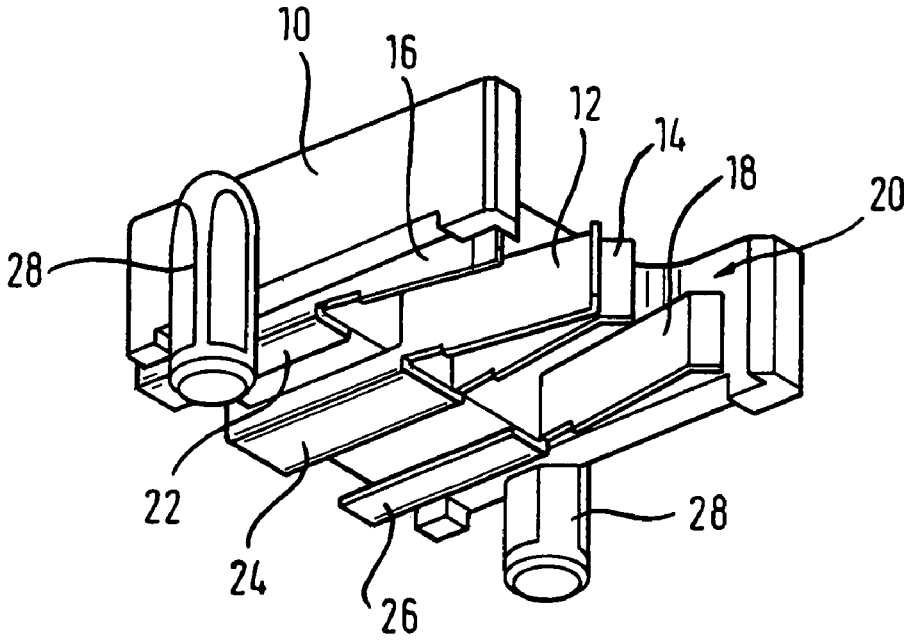
FIG. 2 shows a perspective view from below of the HF connector of FIG. 1.

The preferred embodiment of an HF connector according to the invention shown in FIGS. 1 and 2 is designed as a surface-mounted component (SMD—Surface Mounted Device) and comprises a housing 10, in which a first pair of sprung blades 12, 14 and a second pair of sprung blades 16, 18 are arranged. On one side the housing 10 has a cut-out 20 in which the sprung blades 12, 14, 16, 18 lie free. The sprung blades 12, 14, 16, 18 are arranged and are elastically sprung such that the first pair of sprung blades 12, 14 electrically contacts an inner conductor of an HF coaxial plug connector and the second pair of sprung blades 16, 18 electrically contacts an outer conductor of the HF coaxial plug connector with their respective free ends in the region of the cut-out 20, as will be described in greater detail later. At the respective free ends in the cut-out 20, the sprung blades 12, 14 and 16, 18 of a pair are angled away from each other, resulting in a certain capture range in order to ensure insertion of the HF coaxial plug connector between the sprung blades 12, 14, 16, 18 even if the orientation of the HF coaxial plug connector and the HF connector is such that, due to tolerance variations, they do not exactly align with each other.

As shown in particular by FIG. 2, each sprung blade 12, 14, 16, 18 has a contact surface 22, 24, 28 on an end facing away from the cut-out 20 or the HF coaxial plug connector, wherein the sprung blades 12, 14 of the first pair are formed in one piece in the region of the contact surface 24. These contact surfaces are arranged on one plane and comprise soldering surfaces for electrical contacting of contacts on a circuit board and for mechanical connection with the circuit board, as will be described in greater detail below. Laterally arranged on the housing 10 are pegs 28, which are formed in one piece with the housing 10 and extend substantially perpendicular to the plane of the contact surfaces 22, 24, 26. These pegs 28 serve to engage in corresponding cut-outs in the circuit board in order to position the HF connector precisely relative to the circuit board and to fix it mechanically.

Figure 3:
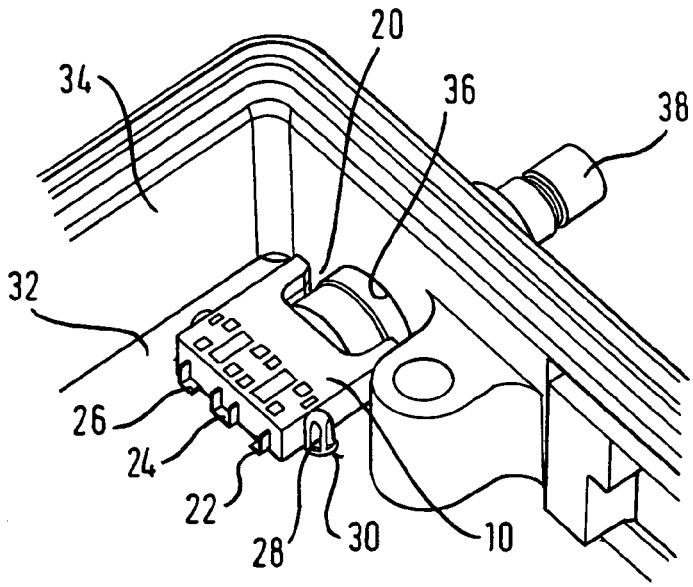
FIG. 3 shows a perspective view from above of the HF connector of FIG. 1 in the installed condition and with an HF coaxial plug connector inserted.
Figure 4:
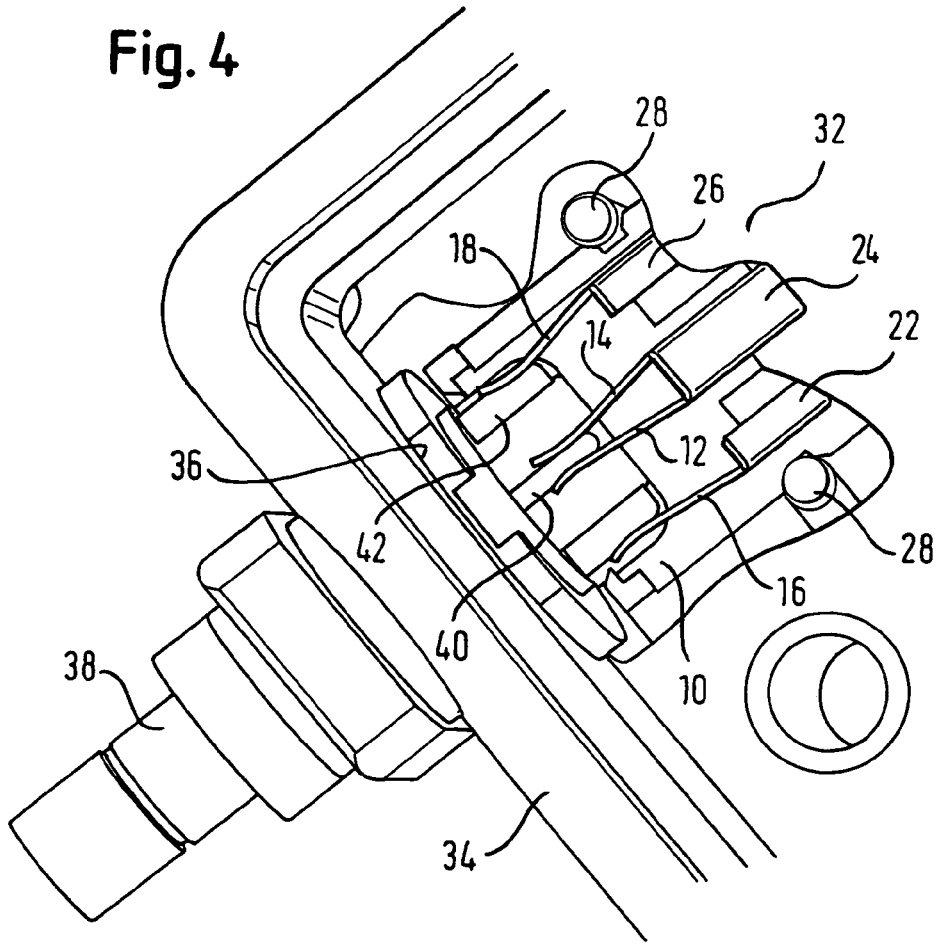
FIG. 4 shows a partially sectional view from below of the HF connector of FIG. 1 in the installed condition and with an HF coaxial plug connector inserted.

FIGS. 3 and 4 illustrate, by way of example, an installed condition of an HF connector according to the invention. The pegs 28 engage in holes 30 in the circuit board 32. This circuit board 32 is already installed in a housing 34. This housing 34 has a perforation 36 for an HF coaxial plug connector 38 with an inner conductor 40 and an outer conductor 42. As is particularly apparent from FIG. 4, after complete closure of the housing 34, the coaxial plug connector can also simply be inserted from outside through the perforation 36, whereby the first pair of sprung blades 12, 14 electrically contact the inner conductor 40 and the second pair of sprung blades 16, 18 electrically contacts the outer conductor 42. Herein, the sprung blades of a pair 12, 14 or 16, 18 are separated from each other such that the inner conductor 40 and the outer conductor 42 press the free, elastically sprung ends of the sprung blades 12, 14, 16, 18 apart such that a corresponding contact force is produced which, together with a contact surface, provides an electrical contact.

A manufacturing method for circuit boards with a housing and a perforation for an HF connection is carried out as follows. Firstly, soldering paste is applied to the circuit board by machine and all the components including the HF connector according to the invention are inserted by machine (using automatic component insertion). Thereafter, the soldering process is carried out in a hot air furnace (by reflow soldering). Herein, the contact surfaces 22, 24, 26 of the HF connector according to the invention are soldered to corresponding contact sites on the circuit board 32. The contact surface 24 of the sprung blades 12, 14 of the first pair, which contacts the central conductor 40 of the HF coaxial plug connector is thereby electrically connected to an HF signal line on the circuit board 32. The contact surfaces 22 and 26 of the sprung blades 16, 18 of the second pair are each electrically connected to chassis contacts on the circuit board 32. As is usual with SMD components, the solder connection also simultaneously creates a mechanical connection with the circuit board 32. Additional mechanical fixing is made available by the two pegs 28, whereby said pegs 28 absorb the laterally acting forces on later insertion of the HF coaxial plug connector, so that said forces do not damage the solder connections. The circuit board 32 is subsequently installed in the housing 43 and said housing 43 is closed. The coaxial plug connector 38 is then inserted through the perforation 36 whereby, due to the arrangement and design of the sprung blades 12, 14, 16, 18 corresponding electrical contacts are made between the HF signal line on the circuit board 32 and the central conductor 40 of the HF coaxial plug connector 38, on the one hand, and between corresponding chassis contacts on the circuit board 34 and the outer conductor 42 of the HF coaxial plug connector 38 and, on the other hand, automatically through the insertion of the HF coaxial plug connector 38 and without further soldering operations, via the HF connector. The HF coaxial plug connector 38 is pressed into the housing 34, whereby this operation can also be performed by machine on a production line.

Figure 5:
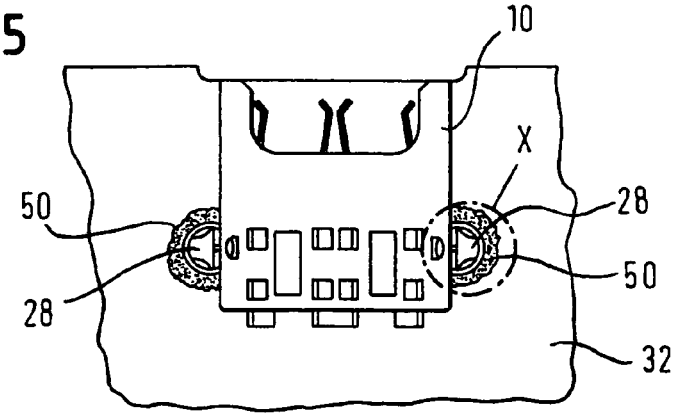
FIG. 5 shows a plan view of a preferred embodiment of a component inserted into a circuit board.

FIG. 5 shows a preferred further development of the component for the circuit board 32. The component comprises the housing 10 and the two pegs 28. In FIG. 1, the component is inserted into the circuit board 32, whereby each peg 28 engages in a metallised hole 30 in the circuit board 32.

Figure 7:
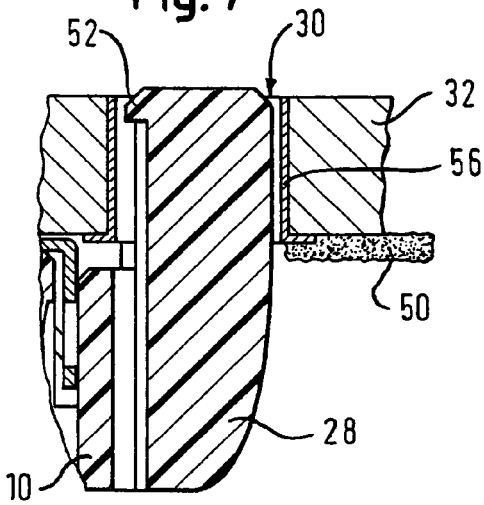
FIG. 7 shows a sectional view along the line A-A of FIG. 6.
Figure 6:
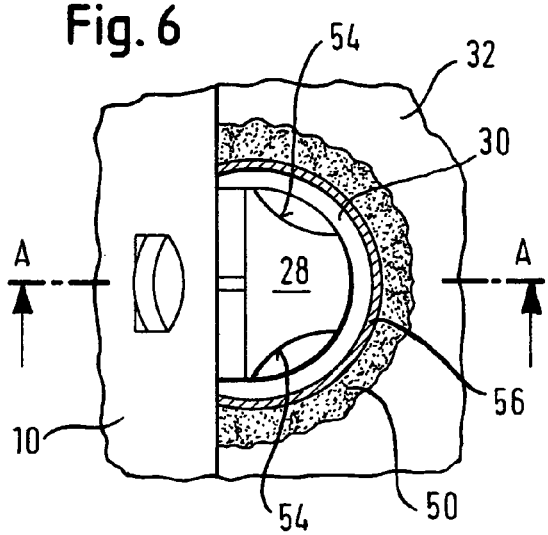
FIG. 6 shows a view of the detail X of FIG. 5 before a soldering procedure.

FIGS. 6 and 7 additionally illustrate the condition of the inserted component before a soldering procedure, whereby metallising 56 of the hole 30 is apparent. Soldering paste 50 is applied round a portion of the periphery of the hole 30, and the peg 28 protrudes into the hole 30. The peg 28 is designed on its free end with a detent lug 52, whereby the diameter of the peg 28 in the region of the detent lug 52 is smaller than the inner diameter of the hole 30. In the remaining portion of the peg 28 which engages in the hole 30, also, the diameter of the peg 28 is smaller than the inner diameter of the hole 30. In addition, the length of the peg 28 is selected such that with the component fully inserted into the circuit board 32, the detent lug 52 is still situated within the hole 30, as is apparent particularly from FIG. 7. Additionally, the peg 28 is provided with cut-outs 54 in the longitudinal direction, as is apparent particularly from FIG. 6. The smaller diameter of the peg 28 compared with the hole 30 and the cut-outs 54 are chosen so that between the outer periphery of the peg 28 and the inner periphery of the hole 30, an intermediate space with capillary properties is formed.

In a manufacturing process wherein initially all the components are inserted into the circuit board 32 by the automatic component inserting machine and subsequently a soldering process takes place in a hot air furnace, the solder 50 is heated and passes to the liquid phase. The liquid solder 50 then penetrates, by means of the capillary action, into the intermediate space between the outer periphery of the peg 28 and the inner periphery of the hole 30 and essentially fills said space completely.

Figure 9:
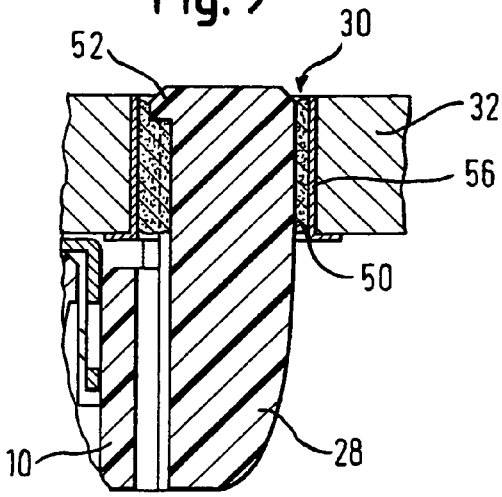
FIG. 8 shows a view of the detail X of FIG. 5 after a soldering procedure and FIG. 9 shows a sectional view along the line B-B of FIG. 8.
Figure 8:
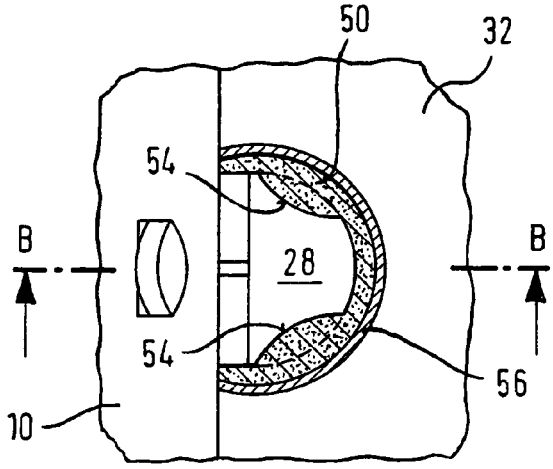

FIGS. 8 and 9 show the condition following cooling and hardening of the solder 50. The intermediate space is filled with solder 50 and said solder 50 has become bound to the metallising 56 of the hole 30 in form-fitting manner. This alone produces a form-fitting connection between the circuit board 32 and the peg 28 in a plane of the circuit board 32. Additionally, by means of the detent lug 52, a form-fit in the direction of the longitudinal axis of the hole 30 is produced, that is, in a direction perpendicular to the circuit board 32. Overall, therefore, the peg 28 is firmly connected and locked to the circuit board 32 in all three spatial directions. As is immediately apparent, however, no insertion force or latching force has to be applied to achieve this. Locking has been automatically achieved during the soldering procedure. It is also apparent that the connection between the peg 28 and the circuit board 32 is tolerance-free.

The invention claimed is:

1. High Frequency (HF) connector for connecting a coaxial plug connector to a HF transmission line on a circuit board, the HF connector comprising:

at least a first pair of spring blades arranged for electrically contacting a central conductor of the coaxial plug connector and at least a second pair of spring blades arranged for electrically contacting an outer conductor of the coaxial plug connector, at least one of the spring blades of the first pair having, on an end facing away from the coaxial plug connector, a contact surface for electrically connecting the HF connector to the HF transmission line on the circuit board and for mechanical connection with the circuit board, and at least one spring blade of the second pair having, on an end facing away from the coaxial plug connector, a contact surface for electrically connecting the HF connector to a chassis contact on the circuit board and for mechanical connection with the circuit board, the HF connector having a housing that carries all the spring blades, the housing having at least one peg which extends away from the housing for engaging the circuit board, the at least one peg being arranged for engaging a metallised hole in the circuit board, the peg having at least one detent lug which extends in the radial direction in relation to the peg, beyond the lug outer periphery, the detent lug being arranged on the peg such that the outer periphery of the peg is smaller in the region of the detent lug than the diameter of the hole in the circuit board, whereby the outer periphery of the section of the peg protruding into the hole in the circuit board is such that between the outer periphery of the section of the peg and the inner wall of the hole in the circuit board, over at least a portion of the outer periphery, there is an intermediate space with capillarity for solder, such that solder situated on the surface of the circuit board during a soldering procedure penetrates into and fills the intermediate space by capillary action.

2. HF connector according to claim 1, wherein the housing has a cut-out into which the free ends of the spring blades which face towards the coaxial plug connector extend.

3. HF connector according to claim 1, wherein the coaxial plug connector has a housing feed-through section for a housing surrounding the circuit board.

4. HF connector according to claim 1, wherein all the spring blades extend in one plane parallel to the plane of the circuit board.

5. HF connector according to claim 1, wherein the spring blades of the first pair have only one piece in the region of the contact surface.

6. HF connector according to claim 1, wherein the spring blades of a pair are angled away from each other at their end facing towards the coaxial plug connector.

7. HF connector according to claim 1, wherein contact surfaces of the spring blades are in a plane parallel to the plane of the circuit board.

8. HF connector according to claim 7, wherein the coaxial plug connector has a housing feed-through section for a housing surrounding the circuit board.

9. HF connector according to claim 8, wherein all the spring blades extend in one plane parallel to the plane of the circuit board.

10. HF connector according to claim 9, wherein the spring blades of the first pair have only one piece in the region of the contact surface.

11. HF connector according to claim 10, wherein the spring blades of a pair are angled away from each other at their end facing towards the coaxial plug connector.

12. HF connector according to claim 1, wherein the housing is a planar component.

13. HF connector according to claim 1, wherein the peg is arranged for engaging a hole in the circuit board, the peg having at feast one detent lug which extends in the radial direction in relation to the peg, beyond the lug outer periphery, the detent lug being arranged on the peg such that the outer periphery of the peg is smaller in the region of the detent lug than the diameter of the hole in the circuit board, whereby the outer periphery of the section of the peg protruding into the hole in the circuit board is such that between the outer periphery of the section of the peg and the inner wall of the hole in the circuit board, over at least a portion of the outer periphery there is an intermediate space with capillarity for solder, such that solder situated on the surface of the circuit board during a soldering procedure penetrates into and fills the intermediate space.

14. HF connector according to claim 13, wherein the detent lug is arranged on the peg such that, with the component fully inserted into the circuit board, the detent lug is within the hole in the circuit board.

15. HF connector according to claim 14, wherein the periphery of the peg in the longitudinal direction over the whole section situated in the hole in the circuit board includes at least one cut-out.

16. HF connector according to claim 1, wherein the connector has a housing which carries all the spring blades.

17. HF connector according to claim 16, wherein the housing has at least one peg which extends away from the housing for engaging the circuit board.

18. HF connector according to claim 17, wherein the peg is arranged for engaging a hole in the circuit board, the peg having at least one detent lug which extends in the radial direction in relation to the peg, beyond the lug outer periphery, the detent lug being arranged on the peg such that the outer periphery of the peg is smaller in the region of the detent lug than the diameter of the hole in the circuit board, whereby the outer periphery of the section of the peg protruding into the hole in the circuit board is such that between the outer periphery of the section of the peg and the inner wall of the hole in the circuit board, over at least a portion of the outer periphery there is an intermediate space with capillarity for solder, such that solder situated on the surface of the circuit board during a soldering procedure penetrates into and fills the intermediate space by capillary action.

* * * * *